United States Patent [19]

Kimura et al.

[11] 4,220,088

[45] Sep. 2, 1980

[54] STATIC-RESISTANT ELECTRIC INITIATOR

[75] Inventors: Michio Kimura; Nobuyuki Izawa; Nobuaki Sakuma, all of Nobeokashi, Japan

[73] Assignee: Asahi Kasei Kogyo Kabushiki Kaisha, Osaka, Japan

[21] Appl. No.: 917,164

[22] Filed: Jun. 20, 1978

[30] Foreign Application Priority Data

| | | | |
|---|---|---|---|
| Jul. 4, 1977 | [JP] | Japan | 52-79059 |
| Jul. 4, 1977 | [JP] | Japan | 52-87555[U] |
| Dec. 9, 1977 | [JP] | Japan | 52-164430[U] |

[51] Int. Cl.[3] ..... F42B 3/10; C06C 3/00

[52] U.S. Cl. ..... 102/28 R

[58] Field of Search ..... 102/28 R, 28 M, 28 EB, 102/46, 203

[56] References Cited

U.S. PATENT DOCUMENTS

| | | | |
|---|---|---|---|
| 2,842,059 | 7/1958 | Plumley et al. | 102/28 R |
| 2,878,752 | 3/1959 | Johnson et al. | 102/28 R |
| 2,999,460 | 9/1961 | Stinger et al. | 102/28 R |
| 3,101,669 | 8/1963 | Gatley et al. | 102/28 R |
| 3,272,127 | 9/1966 | Betts et al. | 102/28 EB |
| 3,867,884 | 2/1975 | Langrish-Smith | 102/27 R |

FOREIGN PATENT DOCUMENTS 51-12683 of 1976 Japan .
51-3165 of 1976 Japan .

*Primary Examiner*—David H. Brown
*Attorney, Agent, or Firm*—Armstrong, Nikaido, Marmelstein & Kubovcik

[57] ABSTRACT

A safe static-resistant electric initiator is constructed by clamping the fitting portion of a cup having a bottom with a protruding part of a plug and the open part of a loaded shell corresponding to said plug. The electric initiator comprises an ignition device and a loaded shell having said ignition device at its open part, said ignition device comprising the cup having a bottom which is breakable by the ignition flame of an ignition composition, an ignition composition filled in said cup, the protruding part for supporting said cup and the plug provided with a bridge wire at the portions of the terminal bared parts of two leg wires which pass through the insides of the plug and said protruding part. Further, for obtaining a superior characteristic of static resistance, the material of said cup is selected, and the clamping ratio of said cup to the protruding part of the plug provided with a bridge wire and the ratio (l/a) of the fitting length (l) between said cup and said protruding part of the plug, to the outside diameter (a) of said cup, are limited to give the most effective ranges.

10 Claims, 4 Drawing Figures

STATIC-RESISTANT ELECTRIC INITIATOR

DESCRIPTION OF THE INVENTION

This invention relates to an electric initiator safe from static electricity. Particularly, it is concerned with a static-resistant electric initiator of the insulation type.

Concomitantly to the recent prevailing trend of ammonium nitrate fuel oil mixture (ANFO), an advent of an electric initiator having a higher safety to static electricity has been desired in order to prevent unforeseen ignition due to static electricity at the time of loading of ANFO.

There are discharge type and insulation type electric initiators, if classified roughly. In the discharge type of electric initiators, by placing a semi-conductive material in the bared portion of leg wires in the vicinity of an ignition composition or by applying a coating of conductive film or by providing a very small spacing between leg wires and a shell, a counter plan is taken to discharge the accumulated electric charge and to prevent the electric charge from accumulation. Because of the complicated structure, the discharge type is not suitable to mass production and moreover, from the point of a notable increase of cost, it is not practically used in customary electric initiators.

On the other hand, in the insulation type, the area around the ignition part is insulated by coating so as not to permit a spark discharge between the bare wires and a shell, but there is a problem, however, in increasing the insulation grade in the area of the ignition part.

In prior art electric initiators consisting of an ignition device and a loaded shell provided with said ignition device at its open part; said ignition device comprises a cup having a bottom part which can be broken by the ignition flame of an ignition composition; an ignition composition filled in said cup; a plug provided with a bridge wire at the portions of the terminal bared parts of two leg wires which penetrate into said plug and a protruding part for supporting said cup. The prior art electric initiator has the open part of the loaded shell corresponding to said plug.

However, in the electric initiator of the above-mentioned structure, since the cup is only simply fitted onto the protruding part of the plug and there has been a problem in the holding strength of said cup to the protruding part of the plug for supporting the cup. Accordingly, there has been a problem in elevating the insulation grade in the area of the ignition part. Further, when the fixing strength of said cup, to the protruding part of the plug is weak, said cup comes off the plug before the bottom part of the cup is broken by the ignition flame of an ignition composition. Thus, in the case where a current is impressed to the bridge wire part, the there has been a fear that a definite flame is not formed.

Recently, for overcoming such a drawback, in the ignition device for electric initiators comprising a cup having a bottom which is breakable by the ignition flame of an ignition composition, the ignition composition is filled in said cup and a plug is provided with a bridge wire at the portions of the terminal bared parts of two leg wires penetrating through the inside of said plug. The ignition device is formed by fitting the circumferential vertical part of said cup, to the plug, by extending it as far as the clamping part of the shell of the plug.

However, when an ignition device of the above-mentioned structure is connected with a loaded shell to form an electric initiator, since only the circumferential edge of said cup is clamped, the main body of the plug is only indirectly clamped by the medium of said cup, the intimate contact of and the main body of the plug with said cup is difficult, and further there is a danger of water entering the inside of the cup and wetting the ignition composition, resulting in the loss of the ignition function and further a danger of the main body of the plug coming off the initiator, etc. when leg wires are pulled. Because of such drawbacks, it is the present status that the above-mentioned ignition device has not been used practically.

Accordingly, it is an object of the present invention to provide an electric initiator which is safer to the static electricity.

The above-mentioned object will be attained by a static-resistant electric initiator of the present invention which is formed by clamping the fitting portion of a cup having a bottom with the protruding part of a plug, and the plug part of a loaded shell corresponding to said plug. The ignition device comprises a cup having a bottom which is breakable by the ignition flame of an ignition composition, an ignition composition filled in said cup, a protruding part for supporting said cup and a plug provided with a bridge wire at the portions of the terminal bared parts of two leg wires which pass through the inside of the plug and said protruding part. The material of said cup is a soft synthetic resin; and the ratio (l/a) of the fitting part length (l) between said cup and said protruding part of the plug, to the outside diameter (a) of said cup, and the clamping ratio of the fitting part between said cup and said protruding part of the plug is specified.

Since a soft synthetic resin is used as the material for the cup, when the open part of the loaded shell corresponding to the fitting part between said cup and said protruding part of the plug is clamped, said cup is fixed tightly to said protruding part of the plug. Accordingly, the area around the ignition composition has a high insulation quality, and thus if a static electricity is impressed between the shell of the initiator and the ignition part, a spark discharge formable between said shell of the initiator and the ignition part is prevented.

Further when a current is impressed through the leg wires to the part of bridge wire, the separation of said cup from said plug can be prevented with certainty before the bottom part of the cup is broken by the ignition flame of the ignition composition and thus a definite flame can be formed. Further in the electric initiator of this invention the open part of the loaded shell corresponding to the plug is also clamped. Since the plug is clamped directly to the shell of the initiator without any intermediate material, the entry of water from the outside as well as the separation of the main body of the plug from the initiator when leg wires are pulled can be prevented.

The electric initiator of the present invention will be described referring to the drawings.

FIGS. 1 (A) and (B) are the cross-sections of one example of the electric initiator of the present invention, partly cut away. FIG. 1 (B) shows a view as seen from the perpendicular (lateral) direction to the view of FIG. 1 (A).

Figure 1A:
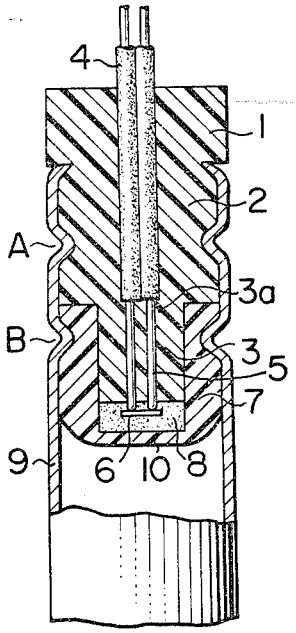
Figure 1B:
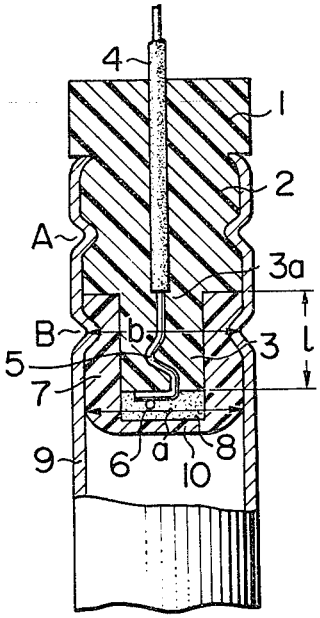

In FIGS. 1 (A) and (B), numeral 1 is the main body of a cylindrical plug and has a fitting part 2 for a shell having a smaller diameter than that of the main body 1 of the plug and a protruding part 3 for supporting a cup molded integrally with the main body 1 of the plug. Leg wires 4 and bare wires 5 penetrate the main body 1 of the plug, and are bared in the area 3*a* of the protruding part. The terminal bared parts of the leg wires 4 are bent along the top surface of the protruding part 3 and at the end thereof a bridge wire 6 is welded.

The cup 7 having a bottom is fitted onto the protruding part 3 of the main body 1 of the plug. The cup 7 is filled with a powdery ignition composition 8 such as lead thiocyanate type, DDNP (diazodinitrophenol) type, etc.

The cup 7 is provided with a cylindrical fitting part fits onto the protruding part 3, of the plug, and the protruding part 3 for supporting the cup is shaped into a cylindrical shape so as to correspond to the cylindrical fitting part of said cup 7.

When an electric initiator is constructed, the ignition device consisting of the cup is filled with an ignition composition and the plug having a bridge wire are fitted to the open part 9 of the loaded shell. The and the fitting part between the cup 7 and the protruding part 3 of the plug and the open part of the loaded shell corresponding to the fitting part 2 of the plug are clamped together at one place, respectively, and at the same time in a ring form. Symbol A shows a clamped or crimped part of the shell and B shows a clamped or crimped part of the cup.

In this case, it does not matter even if the clamping part A of the shell and the clamping part B of the cup can be provided each at a number of places.

Further it does not matter even if the above-mentioned ignition device is arranged for example so as to insert a bridge wire into the powdery ignition composition 8 filled in the cup 7. Further, in addition to the above-mentioned powdery ignition composition 8, a fuse bead adhered to the circumference of the bridge wire 6 can be used in the ignition device.

The ignition device used in the electric initiator of the present invention consists of a plug and a cup having a bottom. The plug is made by the injection molding of rigid thermoplastic resin such as medium density or high density polyethylene, polypropylene, nylon, rigid polyvinyl chloride, etc.

The cup is preferably made of soft synthetic resin as its material which shows a good close adhesion and can be firmly adhered to the protruding part of the plug when it is connected with the loaded shell. For example, an ethylene-vinyl acetate copolymer, an ethylenic ionomer (ionic copolymer obtained by reacting a metal ion with a copolymer consisting of ethylene and an $\alpha$, $\beta$-ethylenic unsaturated carboxylic acid), soft polyvinyl chloride, chlorinated polyethylene, vinyl butyral resin, etc. are suitable. Particularly an ethylene-vinyl acetate copolymer and an ethylenic ionomer which are abundant in softness and easily moldable by injection molding are preferable.

In the electric initiator constructed as above-mentioned, since a soft synthetic resin is used for the cup, the cup elongates easily at the time of clamping of the cup, and since the plug is fixed at the clamping part A of the shell, the cup can be fixed onto the plug firmly in an intimate contact throughout the whole contact surface between the protruding part of the plug and the cup.

It is necessary here to select the ratio of the length (l) of the protruding part of the plug to the outside diameter (a) of the cup 7 so as to satisfy the relation of l/a being 0.35 or more, to increase the insulation grade between the bare wires 5 and the shell of the initiator 9. If l/a is less than 0.35, the clamping of the cup onto the protruding part of the plug to give intimate contact becomes difficult and a definite insulation grade cannot be obtained. If l/a is greater than 1.0, the total length of the cup becomes too long, and on this account the cup becomes unstable and the filling of an ignition composition into the cup and the fitting between the cup and the protruding part of the plug become difficult. Accordingly, in order to hold a good performance of resistance to static electricity at the time of the production as well as in the quality of the product, it is preferable to select the ratio of l/a in the range of 0.35–1.0.

Further, it is necessary to select the clamping or crimping ratio of the clamping part B of the cup, i.e.

$$\text{i.e.}\ \frac{\left(\begin{array}{c}\text{outside diameter } (a) \text{ of}\\ \text{the cup}\end{array}\right) - \left(\begin{array}{c}\text{minimum diameter } (b) \text{ of the clamping}\\ \text{part of the cup}\end{array}\right)}{\left(\begin{array}{c}\text{outside diameter } (a) \text{ of}\\ \text{the cup}\end{array}\right)}$$

in the range of 0.01 or greater in order to keep the definite insulating grade.

Further, if a clamping ratio greater than 0.2 is used, there is a fear that the soft synthetic resin of the cup will be broken because of clamping too tightly, to reduce the insulation grade.

Accordingly, in order to keep a good performance in the resistance to static electricity from the point of production as well as in the quality of the product, it is preferable to select the ratio in the range of 0.01–0.20.

As for the thickness of the bottom part of the cup 7, it will be sufficient if construction is made to give a thin thickness to such an extent that it is easily breakable by means of the ignition flame of the ignition composition 8, but in order to keep the good performance in the resistance to static electricity, it is preferable to select a thickness in the range of 0.2 mm–1.0 mm. If the thickness of the bottom of the cup is less than 0.2 mm, a soft synthetic resin shows difficulty in filling at the bottom part of the cup, in case of injection molding of the cup having a bottom, resulting in pinholes or the like, to reduce the insulation grade between the bare wires 5 and the shell 9.

Further, if the thickness of the cup becomes more than 1.0 mm, the breaking of the bottom of the cup by the ignition flame of the ignition composition becomes difficult and a fear of non-ignition of the electric initiator may be brought about.

Since the electric initiator of the present invention is so constructed as above-mentioned, when static electricity is impressed between the leg wires and the shell, a high insulation grade is maintained between the bare wires 5 and the shell 9, and a high resistance to static electricity is achieved without causing a spark discharge in the area of the ignition part, because a soft synthetic resin is used for the cup; l/a is set to take a value of 0.35 or more in the relation of the length (l) of the protruding part of the plug to the outside diameter (a) of the cup and the clamping part B of the cup is circular and the clamping ratio is selected in the range of 0.01 or greater at the time of connection of the ignition device with the loaded shell.

Further, when a current is impressed through the leg wires into a bridge wire, the separation of the cup from the plug before the separation of the bottom part of the cup by the ignition flame of the ignition composition can be prevented with certainty and a controlled ignition can be formed.

Further, since the fitting part 2 of the plug and the shell 9 are directly clamped together by means of the clamping part A of the shell, without any intermediate material, entry of water from the outside and the separation of the main body 1 of the plug from the electric initiator which may occur at the time of pulling of leg wires 4 can be prevented with certainty.

For producing the electric initiator of the present invention, it will be sufficient if an ignition device formed by fitting a preliminarily prepared plug provided with a bridge wire, into a cup having a bottom, filled with a powdery ignition composition, is clamped at the opening part of a loaded shell. Thus the production method is simple and mass production is possible.

Figure 2:
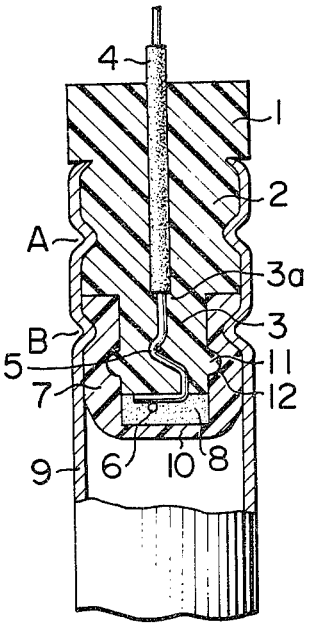
FIG. 2 is the cross-section of another example of the electric initiator of the present invention, partly cut away.
Figure 3:
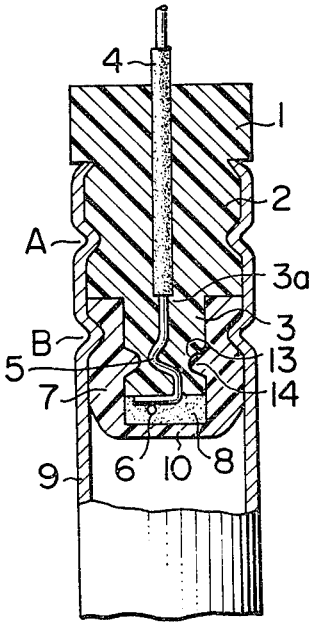
FIG. 3 is the cross-section of a still other example of the electric initiator of the present invention, partly cut away.

In FIGS. 2 and 3, different examples of the electric initiator of the present invention are illustrated.

In FIGS. 2 and 3, on the inner sides of the circumferential vertical part of the cup 7, there is provided a ring-form concave part 12 or a convex part 14, while on the outer circumferential edge of the protruding part 3, of a plug, there is provided a ring-form convex part 11 or a concave part 13.

The position of the convex part 11 or the concave part 13 provided on the outer circumferential edge of the protruding part 3 of a plug corresponds to the position of the concave part 12 or the convex part 14 and is provided in a ring-form over the entire circumferential edge, respectively.

The convex part 11 and the concave part 12 or the concave part 13 and the convex part 14 are provided at arbitrary positions on the fitting surface of the cup 7 onto the protruding part 3, and there is no need of particularly limiting their positions. However, when the above-mentioned ignition device is fitted into the opening part of the loaded shell to form an electric initiator, it is preferable that the clamping part B of the cup be located closer to the side of the open part of the loaded shell than to the engaging portions of said concave and convex part.

In the electric initiator of the present invention thus constructed, the cup 7 is firmly fixed to the protruding part 3 of the plug by the clamping part B of the cup, in addition to the fitting of the convex part 11 to the concave part 12 or the fitting of the concave part 13 to the convex part 14.

Further, when an ignition device is made by mounting the cup 7 on the protruding part 3 of the plug, since the cup 7 and the protruding part of the plug are fixed by the fitting of the convex part 11 to the concave part 12 or that of the concave part 13 to the convex part 14, the separation of the cup 7 from the plug during the production of the electric initiator of the present invention can be prevented and this is advantageous also in the point of safe production.

Following examples are given to illustrate the present invention, but they are not intended to limit the scope of the invention.

EXAMPLE 1

Electric initiators shown in FIG. 1 were prepared by fitting into the open part of a loaded shell, an ignition device comprising plug having leg wires and a bridge wire formed by molding a medium density polyethylene, and a cup having a bottom, formed by molding a soft synthetic resin of ethylene-vinyl acetate copolymer, said cup being filled with a powdery ignition composition consisting of lead thiocyanate and potassium chlorate. The thickness of the bottom part of the cup was made 0.2 mm or 1.0 mm; and the ratio of the length (l) of the protruding part, of the plug to the outside diameter (a) of the cup, i.e. l/a, was varied within the values of 0.3, 0.35, 0.5 and 1.0; and the clamping ratio of the clamped part of the cup was varied within the values of 0, 0.01, 0.05, 0.1 and 0.2.

Between the shunted leg wires and the shell of the electric initiators to be tested, a static electric energy of 0–25 KV charged to a 2000 pF condenser was impressed to measure whether or not an explosion occurs. The results of this experiment are shown in Table 1.

The values in the table show the minimum ignition voltage (KV); l=the length of the protruding part of a plug; a=the outside diameter of the cup;

Table 1 clamping ratio =

$$\frac{\left(\text{the outside diameter (a) of the cup}\right) - \left(\text{minimum diameter (b) of clamped part of the cup}\right)}{\left(\text{the outside diameter (a) of the cup}\right)}$$

| The thickness of the bottom part of the cup having a bottom | 0.2 mm | | | | 1.0 mm | | | |
|---|---|---|---|---|---|---|---|---|
| Clamping ratio | l/a | | | | | | | |
| | 0.3 | 0.35 | 0.5 | 1.0 | 0.3 | 0.35 | 0.5 | 1.0 |
| 0 | 5 (KV) | 5 | 6 | 7 | 5 | 6 | 6 | 7 |
| 0.01 | 6 | 9 | 10 | 11 | 6 | 9 | 10 | 12 |
| 0.05 | 6 | 11 | 13 | 14 | 7 | 12 | 13 | 14 |
| 0.1 | 7 | 13 | 14 | 16 | 7 | 13 | 15 | 17 |
| 0.2 | 7 | 15 | 17 | 18 | 8 | 15 | 17 | 18 |

As evident from the results of Table 1, the electric initiator of this invention is superior in the performance of resistance to static electricity.

EXAMPLE 2

Electric initiators shown in FIG. 1 were prepared by fitting to the open part of a loaded shell, an ignition device comprising a plug having leg wires and a bridge wire formed by molding a medium density polyethylene, and a cup having a bottom, formed by molding a soft synthetic resin of an ethylenic ionomer (which has been formed by reacting a metal ion to a copolymer consisting of ethylene and $\alpha$, $\beta$-ethylenic unsaturated carboxylic acid), the cup being filled with a powdery ignition composition consisting of lead thiocyanate and potassium chlorate. The thickness of the bottom part of the cup was made 0.2 mm or 1.0 mm; and the ratio of the length (l) of the protruding part of the plug to the outside diameter (a) of the cup, i.e. l/a, was varied within the values of 0.3, 0.35, 0.5 and 1.0; and the clamping ratio of the clamped part of the cup was varied within the values of 0, 0.01, 0.05, 0.1 and 0.2.

Between the shunted leg wires and the shell of the electric initiator to be tested, static electric energy of 0–25 KV charged to a 2000 pF condenser was impressed to measure whether or not an explosion occurs. The results of this experiment are shown in Table 2.

Table 2

| The thickness of the bottom part of a cup l/a | 0.2 mm | | | | 1.0 mm | | | |
|---|---|---|---|---|---|---|---|---|
| Clamped ing ratio | 0.3 | 0.35 | 0.5 | 1.0 | 0.3 | 0.35 | 0.5 | 1.0 |
| 0 | 5 KV | 5 | 6 | 7 | 5 | 5 | 6 | 7 |
| 0.01 | 6 | 10 | 10 | 11 | 6 | 10 | 10 | 12 |
| 0.05 | 6 | 11 | 13 | 15 | 7 | 12 | 14 | 15 |
| 0.1 | 7 | 13 | 14 | 16 | 7 | 12 | 15 | 17 |
| 0.2 | 7 | 15 | 17 | 18 | 8 | 15 | 16 | 18 |

As evident from the results of Table 2, it is seen that good performance of resistance to static electricity can be given in case of the use of ethylenic ionomer as a material for the cup.

What is claimed is:

1. In a static-resistant electric initiator comprising an ignition device and a loaded shell having said ignition device inserted in an open end thereof; said ignition device comprising a cup having a bottom filled with an ignition composition, said cup being breakable by the ignition flame of the ignition composition, a plug having a protruding part, said protruding part being fitted within said cup, two leg wires passing through said plug and having bared terminal parts extending from said plug, and a bridge wire embedded in the ignition composition and connected to said bared terminal parts, the improvement wherein said cup is made of one member selected from the group consisting of an ethylene-vinyl acetate copolymer and an ethylenic ionomer, and at least one crimp is formed in said loaded shell and said cup at a position corresponding to that portion of said cup where said plug is fitted into said cup.

2. A static-resistant electric initiator according to claim 1 wherein the thickness of the bottom of said cup is in the range of 0.2 mm to 1.0 mm.

3. A static-resistant electric initiator according to claim 1 wherein said cup comprises a cylindrical fitting part for receiving said protruding part of said plug, and said protruding part of said plug has a cylindrical shape corresponding to said cylindrical fitting part of said cup.

4. A static-resistant electric initiator according to claim 1 wherein said cup has a ring-form concave part at a position within that portion of the cup into which said protruding part is fitted, and said plug has a ring-form convex part on the protruding part thereof corresponding to the concave part on said cup wherein said concave part and said convex part engage each other.

5. A static-resistant electric initiator according to claim 1 wherein said cup has a ring-form convex part at a position within that portion of the cup into which said protruding part is fitted, and said plug has a ring-form concave part at said protruding part thereof corresponding to the convex part on said cup wherein said convex part and said concave part engage each other.

6. A static-resistant electric initiator according to either of claims 4 or 5 wherein said crimp formed in said loaded shell and said cup is located closer to said open end of said loaded shell than to the engaging concave and convex parts.

7. A static-resistant electric initiator according to claim 1 wherein the crimping ratio between said cup and said protruding part of said plug, i.e.

$$\frac{\left(\text{the outside diameter of the cup}\right) - \left(\text{the minimum diameter of the clamped part of the cup}\right)}{\text{(the outside of the cup)}}$$

is 0.01 or higher.

8. A static-resistant electric initiator according to claim 7 wherein said crimping ratio between said cup and said protruding part of said plug is in the range of 0.01–0.2.

9. A static-resistant electric initiator according to claim 1 wherein the ratio (l/a) of the length l of said protruding part of said plug to the outside diameter "a" of said cup is 0.35 or higher.

10. A static-resistant electric initiator according to claim 9 wherein the ratio (l/a) of the length l of said protruding part of said plug to the outside diameter "a" of said cup is in the range of 0.35 to 1.0.

* * * * *